US011112131B2

(12) United States Patent
Koike et al.

(10) Patent No.: US 11,112,131 B2
(45) Date of Patent: Sep. 7, 2021

(54) HEAT SOURCE UNIT WITH CORRUGATED BOTTOM PLATE

(71) Applicant: DAIKIN INDUSTRIES, LTD., Osaka (JP)

(72) Inventors: Fumiaki Koike, Osaka (JP); Shigeki Kamitani, Osaka (JP); Daiki Hirawa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 89 days.

(21) Appl. No.: 16/095,310

(22) PCT Filed: Apr. 17, 2017

(86) PCT No.: PCT/JP2017/015463
§ 371 (c)(1),
(2) Date: Oct. 19, 2018

(87) PCT Pub. No.: WO2017/183607
PCT Pub. Date: Oct. 26, 2017

(65) Prior Publication Data

US 2019/0137119 A1 May 9, 2019

(30) Foreign Application Priority Data

Apr. 21, 2016 (JP) ..... JP2016-084985

(51) Int. Cl.
*F24F 13/22* (2006.01)
*F24F 1/36* (2011.01)
(Continued)

(52) U.S. Cl.
CPC ..... *F24F 1/36* (2013.01); *F24F 1/46* (2013.01); *F24F 1/56* (2013.01); *F24F 13/22* (2013.01); *F24F 13/222* (2013.01)

(58) Field of Classification Search
CPC ..... F24F 1/36; F24F 13/22; F24F 13/222
See application file for complete search history.

(56) References Cited

U.S. PATENT DOCUMENTS

2002/0134099 A1 9/2002 Mochizuki et al.
2014/0202191 A1* 7/2014 Jinnai ..... F24F 1/36 62/275

(Continued)

FOREIGN PATENT DOCUMENTS

EP 2787292 A1 10/2014
JP 2001-201108 A 7/2001

(Continued)

OTHER PUBLICATIONS

Notification of Transmittal of Translation of the International Preliminary Report on Patentability for International Application No. PCT/JP2017/015463 dated Nov. 1, 2018 (1 page).

(Continued)

*Primary Examiner* — Frantz F Jules
*Assistant Examiner* — Lionel Nouketcha
(74) *Attorney, Agent, or Firm* — Osha Bergman Watanabe & Burton LLP

(57) ABSTRACT

A heat source unit includes: a corrugated plate-like bottom frame in which ridges and furrows extend across the front and rear direction or across the right and left direction; and mounting feet. The mounting feet include: supports that support, from below, the furrows of supported ends of the bottom frame on sides that the ridges and the furrows can be seen; and walls disposed on outer sides of the supported ends and that extend upward from the supports. Water drainage passages, that drain water sticking to tops of the ridges of the supported ends to the supports, are disposed above the supports.

7 Claims, 8 Drawing Sheets

(51) Int. Cl.
*F24F 1/56* (2011.01)
*F24F 1/46* (2011.01)

(56) References Cited

U.S. PATENT DOCUMENTS

| | | | | |
|---|---|---|---|---|
| 2015/0000321 | A1 | 1/2015 | Kagawa et al. | |
| 2016/0076796 | A1* | 3/2016 | Lee | F25B 13/00 62/498 |

FOREIGN PATENT DOCUMENTS

| | | | | |
|---|---|---|---|---|
| JP | 2011-158137 | A | | 8/2011 |
| JP | 2011158149 | A | | 8/2011 |
| JP | 2013-113563 | A | | 6/2013 |
| JP | 2016-38175 | A | | 3/2016 |
| JP | 2016038175 | A | * | 3/2016 |

OTHER PUBLICATIONS

International Preliminary Report on Patentability issued in corresponding International Application No. PCT/JP2017/015463 dated Oct. 23, 2018 (6 pages).
Extended European Search Report issued in corresponding European Patent Application 17785945.1 dated Mar. 29, 2019 (7 pages).
International Search Report issued in corresponding International Application No. PCT/JP2017/015463 dated Jul. 11, 2017, with translation (5 pages).

* cited by examiner

HEAT SOURCE UNIT WITH CORRUGATED BOTTOM PLATE

TECHNICAL FIELD

The present invention relates to a heat source unit, and particularly a heat source unit having a corrugated plate-like bottom frame and mounting feet.

BACKGROUND

Conventionally, there is an air conditioning system configured as a result of a heat source unit and a utilization unit being connected by pipes. Examples of the heat source unit configuring this kind of air conditioning system include a heat source unit having a corrugated plate-like bottom frame and mounting feet, such as described in patent document 1 (JP-A No. 2011-158137). Specifically, the bottom frame is a corrugated plate-like member in which ridge portions and furrow portions extending across the right and left direction are formed. The mounting feet support the left end portion and the right end portion of the bottom frame from below.

In the heat source unit, numerous openings serving as water drainage passages are formed in the bottom frame in order to improve the water drainage performance of the bottom frame. However, when numerous openings are formed in the bottom frame, there is the concern that the strength of the bottom frame will be reduced. To address this, it is conceivable to employ a high-strength corrugated plate-like bottom frame as in the heat source unit of patent document 1. Because of this, the number of openings can be increased to improve the water drainage performance while tolerating a reduction in the strength of the bottom frame.

However, the ridge portions and the furrow portions are formed in the corrugated plate-like bottom frame, there is a tendency for water to easily accumulate, and there is the concern that a level will be reached at which the number of openings is increased too much and a reduction in the strength of the bottom frame cannot be tolerated.

For this reason, even in the case of employing a corrugated plate-like bottom frame, it is required to provide water drainage passages while reducing as much as possible a reduction in strength.

SUMMARY

One or more embodiments of the present invention achieve, in a heat source unit having a corrugated plate-like bottom frame and mounting feet, a balance between maintaining the strength of the bottom frame and improving the water drainage performance.

A heat source unit pertaining to one or more embodiments of a first aspect has a bottom frame and mounting feet. The bottom frame is a corrugated plate-like member in which ridge portions (ridges) and furrow portions (furrows) extending across the front and rear direction or the right and left direction are formed. The mounting feet have: support portions (supports) that support, from below, the furrow portions of supported end portions (supported ends) that are end portions of the bottom frame on sides at which the ridge portions and the furrow portions can be seen; and wall portions (walls) that are positioned on outer sides of the supported end portions and extend upward from the support portions. Additionally, here, water drainage passages for draining, to the support portions, water sticking to tops of the ridge portions of the supported end portions are formed above the support portions of the mounting feet.

Here, the water drainage passages are provided in the ridge portions of the supported end portions—whose strength is increased as a result of the furrow portions being supported by the support portions of the mounting feet—of the bottom frame, so a balance between maintaining the strength of the bottom frame and improving the water drainage performance can be achieved.

A heat source unit pertaining to one or more embodiments of a second aspect is the heat source unit pertaining to embodiments of the first aspect, wherein the water drainage passages are clearances formed between the ridge portions of the supported end portions and the wall portions.

Here, the strength of the bottom frame can be maintained more reliably compared to a case where the water drainage passages are provided by forming openings in the ridge portions of the supported end portions. Furthermore, in a case where the clearances serving as the water drainage passages are also formed in the furrow portions adjacent to the ridge portions of the supported end portions, not only water sticking to the ridge portions of the supported end portions but also water sticking to the tops of the furrow portions of the supported end portions can be drained to the support portions, so the water drainage performance can be further improved.

A heat source unit pertaining to one or more embodiments of a third aspect is the heat source unit pertaining to embodiments of the second aspect, wherein the clearances are 2 mm or greater.

Here, the clearances serving as the water drainage passages are 2 mm or greater, so water sticking to the tops of the ridge portions of the supported end portions and water sticking to the tops of the furrow portions adjacent to the ridge portions of the supported end portions can be reliably drained to the support portions.

A heat source unit pertaining to one or more embodiments of a fourth aspect is the heat source unit pertaining to embodiments of the second or embodiments of the third aspect, wherein the wall portions have abutting wall portions (abutting walls) that abut against the supported end portions and non-abutting wall portions (non-abutting walls) that do not abut against the supported end portions. The clearances are formed between the supported end portions and the non-abutting wall portions as a result of the abutting wall portions being in abutment against the supported end portions.

Here, the clearances can be reliably formed between the ridge portions of the supported end portions and the wall portions by the abutting wall portions.

A heat source unit pertaining to one or more embodiments of a fifth aspect is the heat source unit pertaining to embodiments of the first aspect, wherein the water drainage passages are openings formed in portions of the ridge portions of the supported end portions that oppose the support portions from above.

Here, the water drainage passages are openings, so there is concern of a reduction in the strength of the bottom frame, but as described above, the openings serving as the water drainage passages are provided in the ridge portions of the supported end portions—whose strength is increased as a result of the furrow portions being supported by the support portions of the mounting feet—of the bottom frame, so a balance between maintaining the strength of the bottom frame and improving the water drainage performance can be achieved.

A heat source unit pertaining to one or more embodiments of a sixth aspect is the heat source unit pertaining to embodiments of any of the first to fifth aspects, wherein the wall portions extend to a position higher than upper ends of the ridge portions of the supported end portions.

Here, water sticking to the tops of the ridge portions of the supported end portions can be prevented from going outside the bottom frame from the wall portions.

A heat source unit pertaining to one or more embodiments of a seventh aspect is the heat source unit pertaining to embodiments of any of the first to sixth aspects, wherein downward slopes heading toward the water drainage passages are formed in the supported end portions.

Here, water sticking to the tops of the ridge portions of the supported end portions can be guided to the water drainage passages, and because of this, the water drainage performance can be further improved.

DETAILED DESCRIPTION

Embodiments of a heat source unit pertaining to the invention, and example modifications thereof, will be described below on the basis of the drawings. It will be noted that the specific configurations of the heat source unit pertaining to the invention are not limited to those in the following embodiments and the example modifications thereof and can be changed in a range that does not depart from the spirit of the invention.

(1) Configuration of Air Conditioning System

Figure 1:
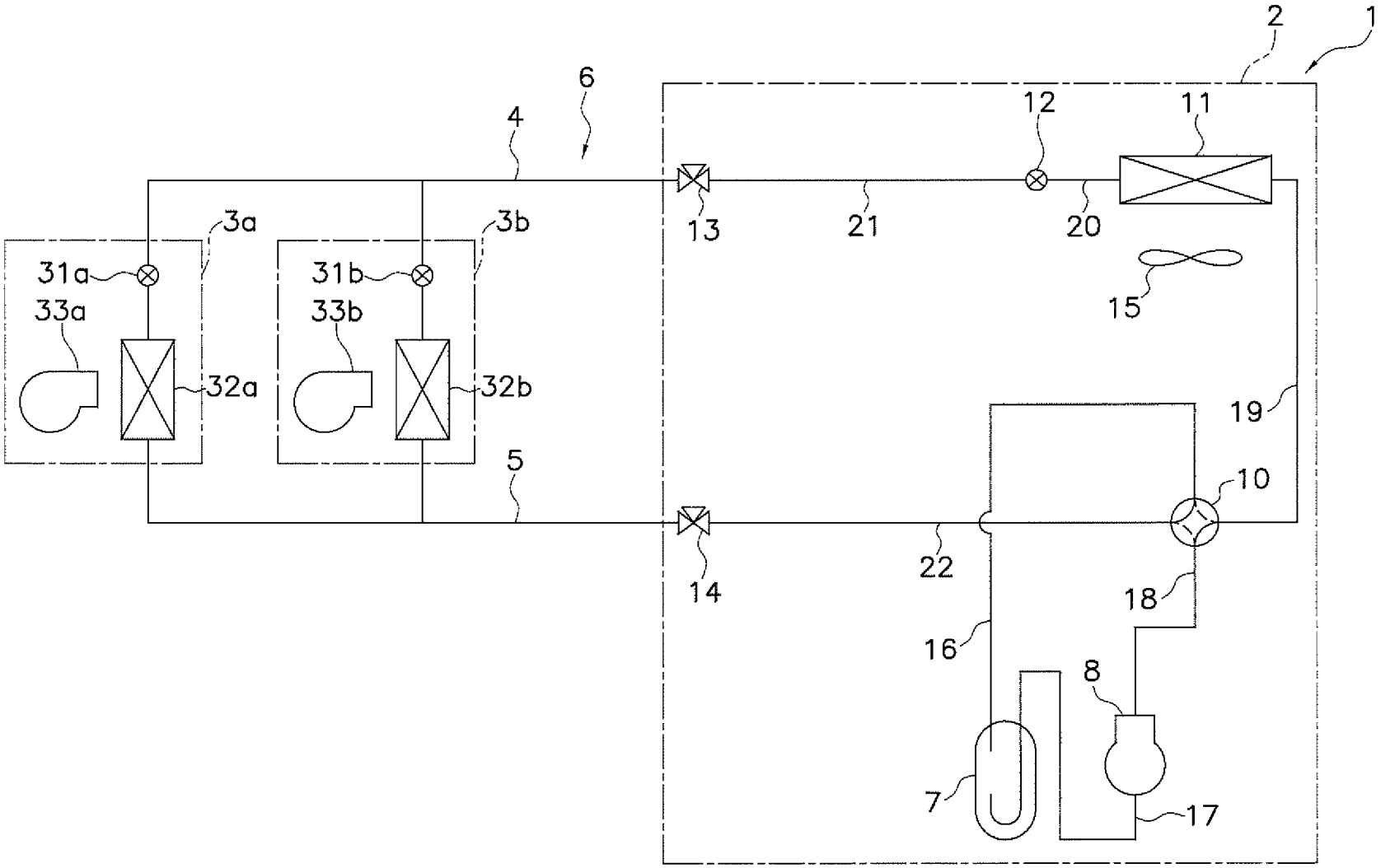
FIG. 1 is a general configuration diagram of an air conditioning system in which a heat source unit pertaining to one or more embodiments of the invention is employed.

FIG. 1 is a general configuration diagram of an air conditioning system 1 in which a heat source unit 2 pertaining to one or more embodiments of the invention is employed.

The air conditioning system 1 is a system that can perform cooling and heating of rooms in a building, for example, by performing a vapor compression refrigeration cycle. The air conditioning system 1 is configured as a result of mainly the heat source unit 2 and utilization units 3*a* and 3*b* being connected. Here, the heat source unit 2 and the utilization units 3*a* and 3*b* are connected via a liquid refrigerant communication pipe 4 and a gas refrigerant communication pipe 5. That is, a vapor compression refrigerant circuit 6 of the air conditioning system 1 is configured as a result of the heat source unit 2 and the utilization units 3*a* and 3*b* being connected via the refrigerant communication pipes 4 and 5.

The heat source unit 2 is installed outdoors (e.g., on the roof of the building or adjacent to a wall surface of the building) and configures part of the refrigerant circuit 6. The heat source unit 2 mainly has an accumulator 7, a compressor 8, a four-port switching valve 10, a heat source-side heat exchanger 11, a heat source-side expansion valve 12, a liquid-side stop valve 13, a gas-side stop valve 14, and a heat source-side fan 15. The devices and valves are connected to each other by refrigerant pipes 16 to 22.

The utilization units 3*a* and 3*b* are installed in rooms (e.g., living rooms or spaces on the reverse sides of ceilings) and configure part of the refrigerant circuit 6. The utilization unit 3*a* mainly has a utilization-side expansion valve 31*a*, a utilization-side heat exchanger 32*a*, and a utilization-side fan 33*a*. The utilization unit 3*b* mainly has a utilization-side expansion valve 31*b*, a utilization-side heat exchanger 32*b*, and a utilization-side fan 33*b*.

The refrigerant communication pipes 4 and 5 are refrigerant pipes constructed on site when installing the air conditioning system 1 in an installation location such as a building. One end of the liquid refrigerant communication pipe 4 is connected to the liquid-side stop valve 13 of the heat source unit 2, and the other end of the liquid refrigerant communication pipe 4 is connected to liquid-side ends of the utilization-side expansion valves 31*a* and 31*b* of the utilization units 3*a* and 3*b*. One end of the gas refrigerant communication pipe 5 is connected to the gas-side stop valve 14 of the heat source unit 2, and the other end of the gas refrigerant communication pipe 5 is connected to gas-side ends of the utilization-side heat exchangers 32*a* and 32*b* of the utilization units 3*a* and 3*b*.

(2) Configuration of Heat Source Unit

Figure 2:
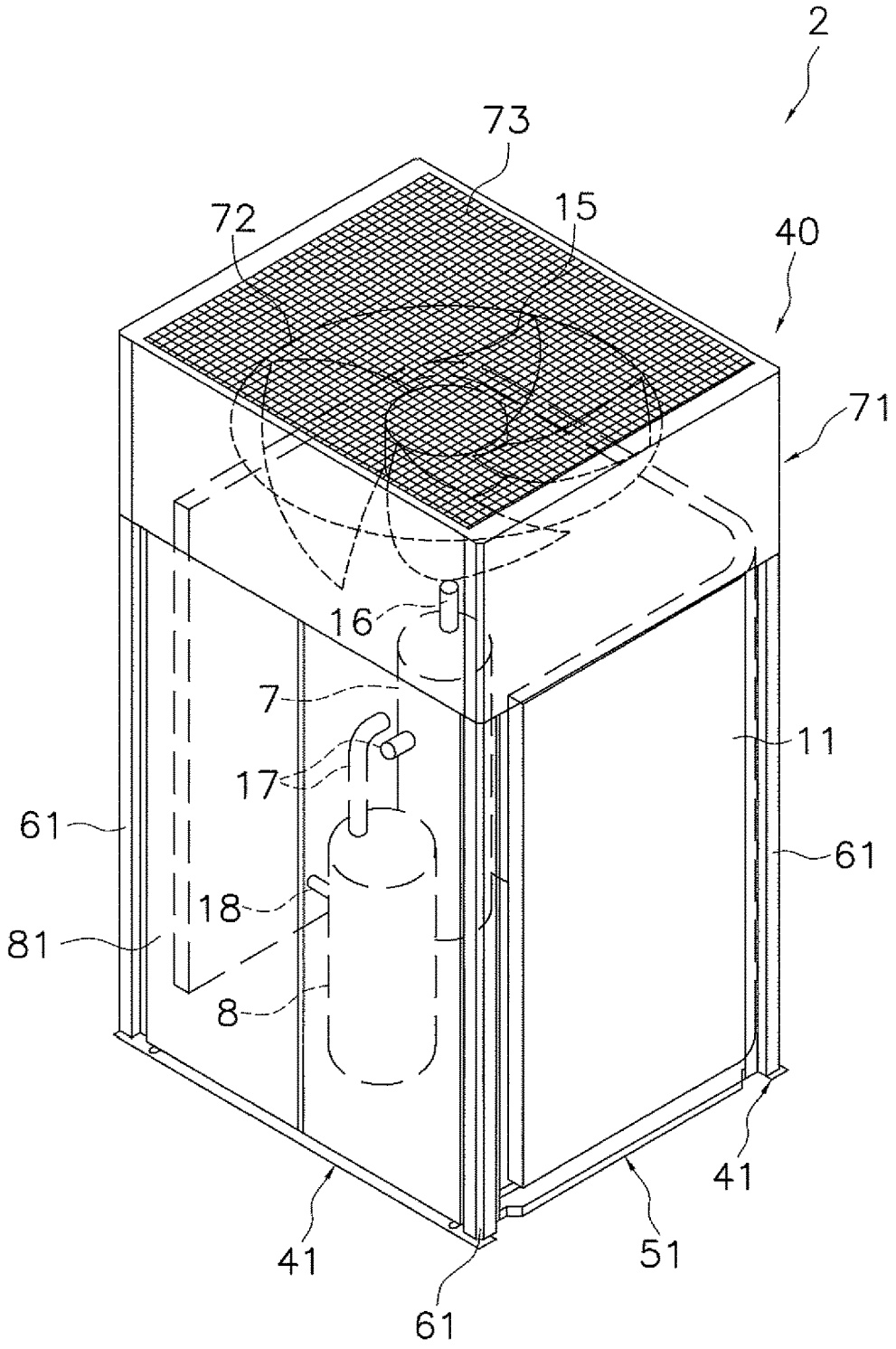
FIG. 2 is an external perspective view of the heat source unit according to one or more embodiments.
Figure 3:
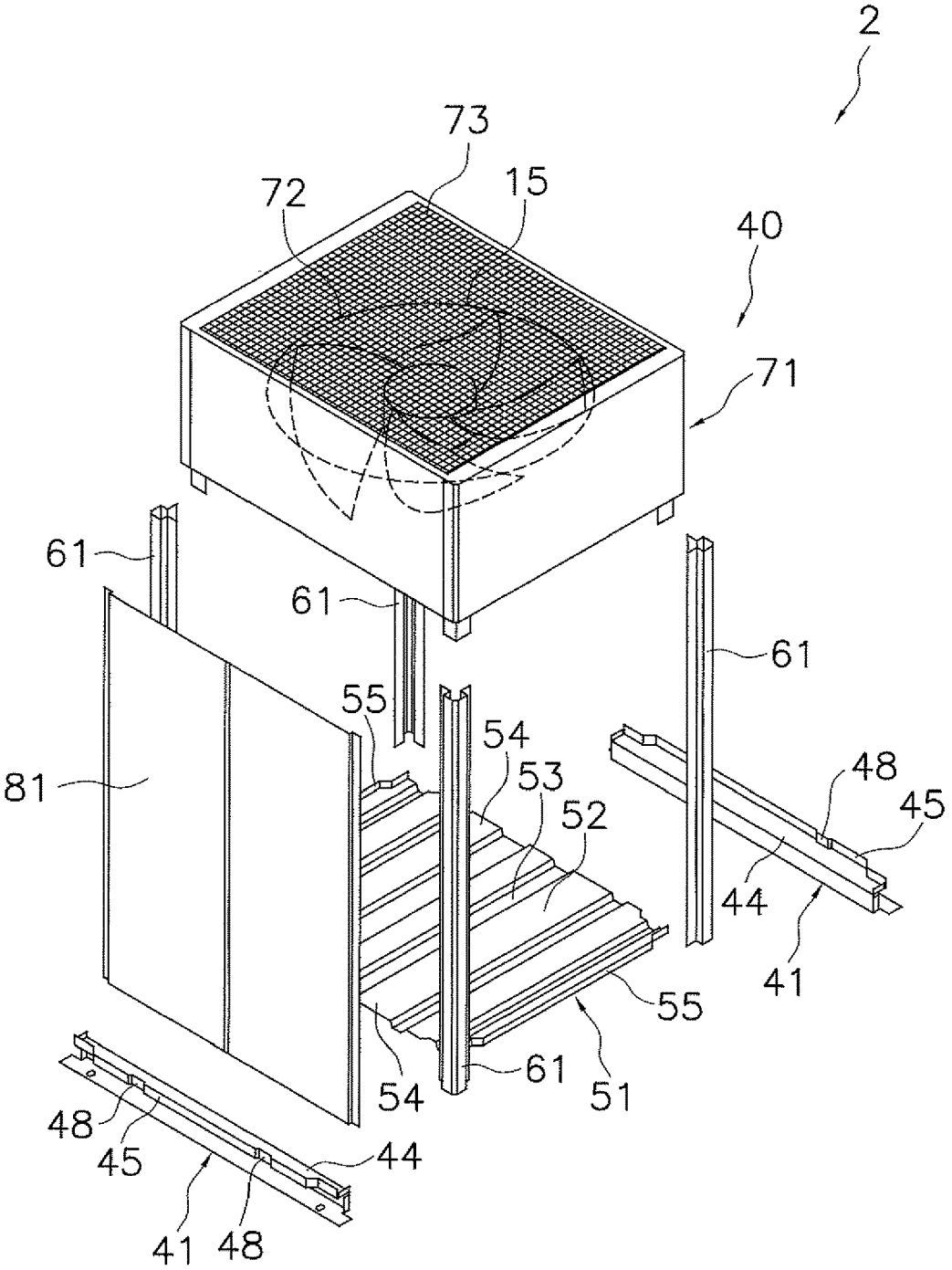
FIG. 3 is an exploded perspective view of the heat source unit (excluding refrigerant circuit constituent parts) according to one or more embodiments.
Figure 4:
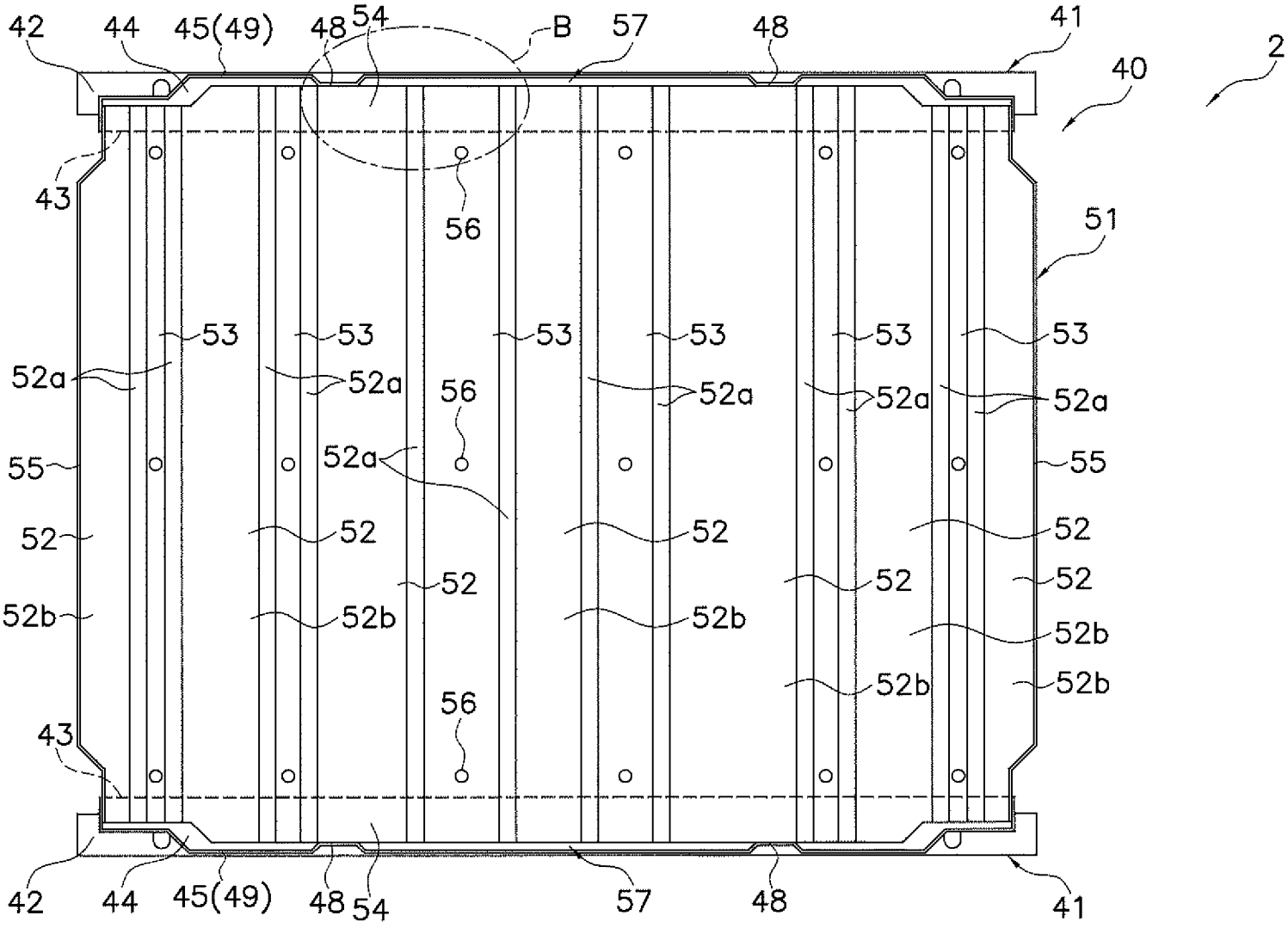
FIG. 4 is a plan view showing a bottom frame and mounting feet (excluding refrigerant circuit constituent parts) according to one or more embodiments.
Figure 5:
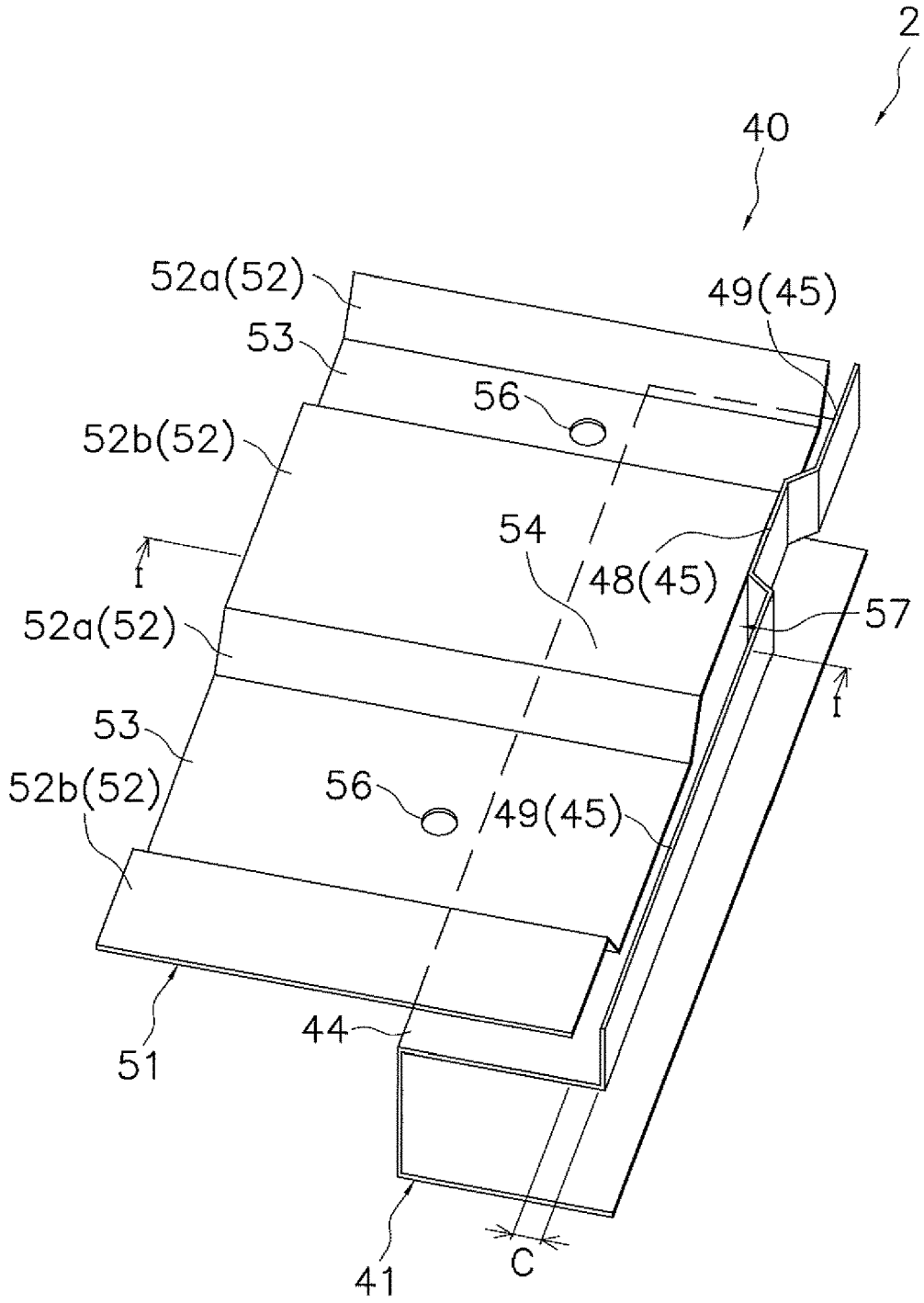
FIG. 5 is a perspective view (exemplifying portion B of FIG. 4) showing the bottom frame and a mounting foot according to one or more embodiments.
Figure 6:
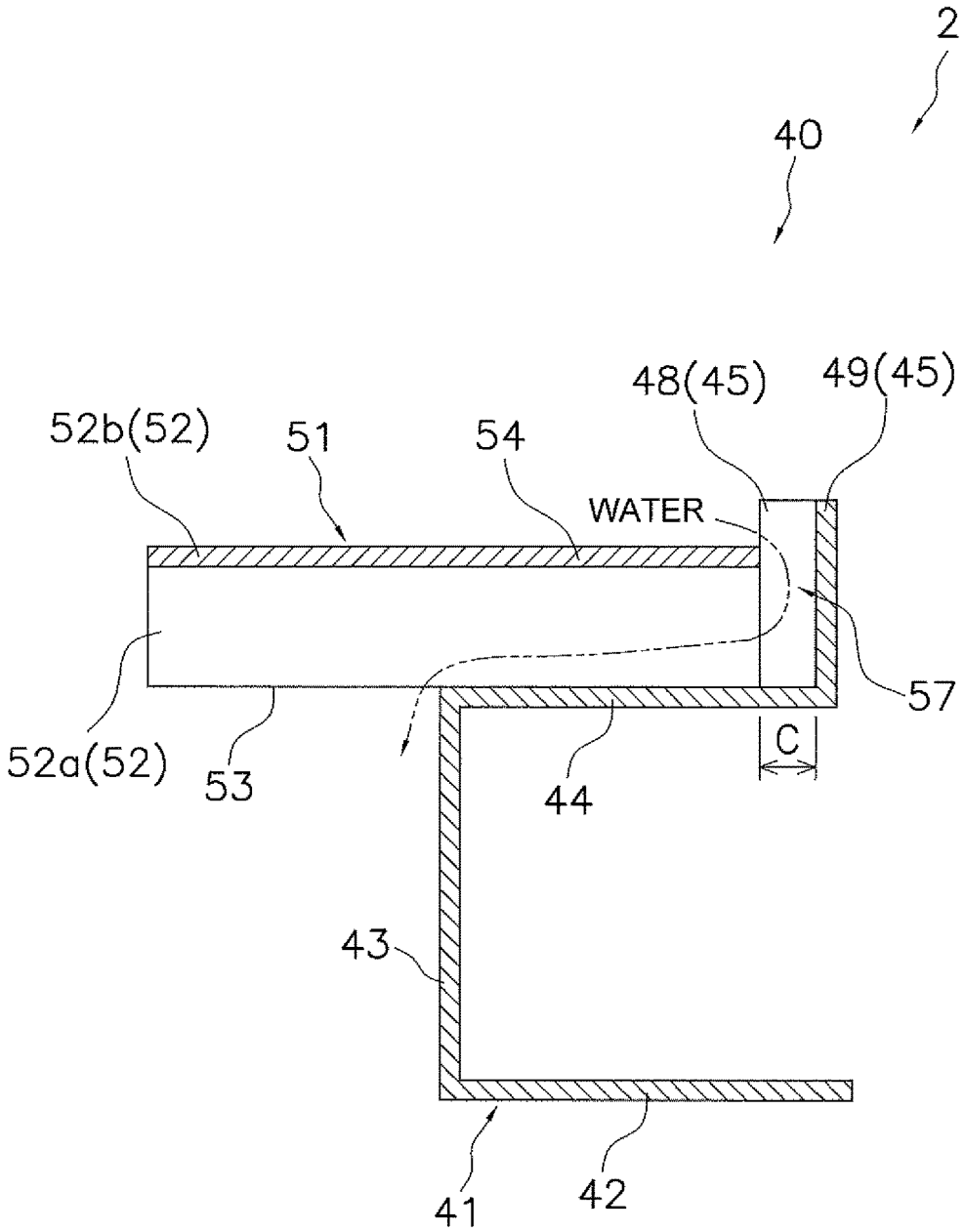
FIG. 6 is a sectional view (a sectional view along line I-I of FIG. 5) showing the bottom frame and the mounting foot according to one or more embodiments.

FIG. 2 is an external perspective view of the heat source unit 2 according to one or more embodiments. FIG. 3 is an exploded perspective view of the heat source unit 2 (excluding refrigerant circuit constituent parts) according to one or more embodiments. FIG. 4 is a plan view showing a bottom frame 51 and mounting feet 41 (excluding refrigerant circuit constituent parts) according to one or more embodiments. FIG. 5 is a perspective view (exemplifying portion B of FIG. 4) showing the relation between the bottom frame 51 and the mounting feet 41 according to one or more embodiments. FIG. 6 is a sectional view (a sectional view along line I-I of FIG. 5) showing the relation between the bottom frame 51 and the mounting feet 41 according to one or more embodiments.

<Overall Structure>

The heat source unit 2 has what is called an upward-blowing structure that takes air into a casing 40 from below and blows the air out to the outside of the casing 40 from above. The heat source unit 2 mainly has the casing 40 substantially in the shape of a rectangular parallelepiped box, the heat source-side fan 15, and refrigerant circuit constituent parts that configure part of the refrigerant circuit 6 and include the devices 7, 8, and 11 such as the compressor and the heat source-side heat exchanger, the valves 10 and 12 to 14 such as the four-port switching valve and the heat source-side expansion valve, and the refrigerant pipes 16 to 22. It will be noted that in the following description, unless otherwise specified the expressions "upper," "lower," "left," "right," "front," "rear," "front surface," and "back surface" will mean directions in a case where the heat source unit 2 shown in FIG. 2 is seen from the front (diagonally forward and to the left in the drawing).

The casing 40 mainly has a bottom frame 51 that bridges a pair of mounting feet 41 extending in the right and left direction, struts 61 that extend in the vertical direction from corner portions of the bottom frame 51, a fan module 71 that is attached to the upper ends of the struts 61, and a front surface panel 81.

The bottom frame 51 forms a bottom surface of the casing 40, and the heat source-side heat exchanger 11 is provided on the bottom frame 51. Here, the heat source-side heat exchanger 11 is a heat exchanger that is substantially U-shaped as seen in a plan view and faces the back surface and both right and left side surfaces of the casing 40, and substantially forms the back surface and both right and left side surfaces of the casing 40.

The fan module 71 is provided on the upper side of the heat source-side heat exchanger 11 and forms a top surface of the casing 40 and sections of the front surface, the back surface, and both right and left side surfaces of the casing 40 on the upper side of the struts 61. Here, the fan module 71 is a composite body where the heat source-side fan 15 and a bell mouth 72 are housed in a substantially rectangular parallelepiped-shaped box whose upper surface and lower surface are open, and an air outlet grille 73 is provided in the opening in the upper surface.

The front surface panel 81 bridges the struts 61 on the front surface side and forms a front surface of the casing 40.

Also housed inside the casing 40 are refrigerant circuit constituent parts other than the heat source-side fan 15 and the heat source-side heat exchanger 11 (FIG. 2 shows the accumulator 7, the compressor 8, and the refrigerant pipes 16 to 18). Here, the compressor 8 is a device that compresses refrigerant and is provided on the bottom frame 51. Furthermore, the accumulator 7 is a refrigerant vessel that temporarily accumulates the refrigerant before the refrigerant is sucked into the compressor 8, and the accumulator 7 is provided on the bottom frame 51.

<Detailed Structure (Including Structure for Improving Water Drainage Performance of Bottom Frame 51)>

The bottom frame 51 is a corrugated plate-like member in which ridge portions 52 and furrow portions 53 extending across the front and rear direction of the casing 40 are formed. Here, the furrow portions 53 are portions that form the bottom surface of the bottom frame 51 (here, portions that form substantially flat surfaces and are lowermost in the bottom frame 51). The ridge portions 52 are portions that project upward from the furrow portions 53 (here, portions 52*a* that form sloping surfaces heading upward from the furrow portions 53 and portions 52*b* that form substantially flat surfaces and are positioned higher than the furrow portions 53 connected to the portions 52*a*). The bottom frame 51 bridges the mounting feet 41. Supported end portions 54, which are end portions of the bottom frame 51 on sides (here, in the front and rear direction) where the ridge portions 52 and the furrow portions 53 can be seen, are supported by the mounting feet 41. Outer wall portions 55 that extend upward beyond the ridge portions 52 and the furrow portions 53 are formed on end portions of the bottom frame 51 on sides (here, in the right and left direction) orthogonal to the supported end portions 54. Additionally, in contrast to the right and left direction end portions of the bottom frame 51, outer wall portions are not formed on the supported end portions 54, and so the shape of the bottom frame 51 is simplified.

The mounting feet 41 are members that are substantially C-shaped as seen in a side view and extend in the right and left direction of the casing 40. The mounting feet 41 each mainly have an anchored portion 42 that becomes anchored to an installation surface, a vertical portion 43 that extends upward from an end portion of the anchored portion 42 on one side in the front and rear direction, and a support portion 44 that extends horizontally from the upper end portion of the vertical portion 43 toward the other side in the front and rear direction. The support portions 44 support the furrow portions 53 of the supported end portions 54 from below. Furthermore, the mounting feet 41 each have a wall portion 45 that extends upward from the end portion of the support portion 44 on the other side in the front and rear direction. The wall portions 45 are positioned on outer sides of the supported end portions 54. That is, in the case of the mounting foot 41 disposed on the front surface side of the casing 40, the wall portion 45 is positioned on the front side of the supported end portion 54, and in the case of the mounting foot 41 disposed on the back surface side of the casing 40, the wall portion 45 is positioned on the back surface side of the supported end portion 54. Additionally, the wall portions 45 of the mounting feet 41 function as outer wall portions of the front and rear direction end portions of the bottom frame 51. That is, here, the wall portions 45 of the mounting feet 41 have the same function as the outer wall portions 55 of the right and left direction end portions of the bottom frame 51, while simplifying the shape of the bottom frame 51.

In this corrugated plate-like bottom frame 51, there is a tendency for water to easily accumulate because the ridge portions 52 and the furrow portions 53 are formed. For this reason, first, in the furrow portions 53 where it is easiest for water to accumulate, numerous openings 56 are formed so that water sticking to the tops of the furrow portions 53 can be drained. However, in the bottom frame 51, water also sticks to the tops of the ridge portions 52, so it is also necessary to consider draining the water sticking to the tops of the ridge portions 52. If, to address this, numerous openings are also formed in the ridge portions 52 as in the furrow portions 53, there is the concern that a level will be reached at which the number of openings is increased too much and a reduction in the strength of the bottom frame 51 cannot be tolerated. For this reason, in the heat source unit 2 employing the corrugated plate-like bottom frame 51, it is required to provide water drainage passages while reducing as much as possible a reduction in strength.

Therefore, here, water drainage passages 57 for draining, to the support portions 44, water sticking to the tops of the ridge portions 52 of the supported end portions 54 are formed above the support portions 44 of the mounting feet 41. Specifically, clearances C are formed between the ridge portions 52 of the supported end portions 54 and the wall portions 45 of the mounting feet 41. Here, the support portions 44 are in contact with and support the furrow portions 53 of the supported end portions 54 from below, but spaces are formed in the up and down direction between the support portions 44 and the ridge portions 52 of the supported end portions 54. Additionally, the spaces communicate with the clearances C, so the clearances C can function as the water drainage passages 57. Furthermore, 2 mm or more is ensured for the clearances C. Moreover, the clearances C are formed not only between the ridge portions 52 of the supported end portions 54 and the wall portions 45 but also between the furrow portions 53 of the supported end portions 54 and the wall portions 45.

Additionally, by employing this structure, in the heat source unit 2, a balance can be achieved between maintaining the strength of the bottom frame 51 and improving the water drainage performance. Here, the supported end portions 54 of the bottom frame 51 are increased in strength as a result of being supported by the support portions 44 of the mounting feet 41. For this reason, even when the water drainage passages 57 are formed, a reduction in the strength of the bottom frame 51 can be reduced as much as possible. That is, here, the water drainage passages 57 are provided in the supported end portions 54—whose strength is increased as a result of being supported by the support portions 44 of the mounting feet 41—of the ridge portions 52 of the bottom frame 51, so a balance between maintaining the strength of the bottom frame 51 and improving the water drainage performance can be achieved. Furthermore, water that has been guided through the water drainage passages 57 to the support portions 44 falls under the bottom frame 51 through the spaces in the up and down direction between the support portions 44 and the ridge portions 52 of the supported end portions 54, so it is difficult for the water to flow out to the outside of the heat source unit 2.

Furthermore, here, the strength of the bottom frame 51 can be maintained more reliably compared to a case where the water drainage passages are provided by forming openings in the ridge portions 52 of the supported end portions 54 (see the example modifications described later). Furthermore, here, the clearances C serving as the water drainage passages 57 are also formed in the furrow portions 53 adjacent to the ridge portions 52 of the supported end portions 54, so not only water sticking to the ridge portions 52 of the supported end portions 54 but also water sticking to the tops of the furrow portions 53 of the supported end portions 54 can be drained to the support portions 44, so the water drainage performance can be further improved. Moreover, here, the clearances C serving as the water drainage passages are 2 mm or greater, so water sticking to the tops of the ridge portions 52 of the supported end portions 54 and water sticking to the tops of the furrow portions 53 adjacent to the ridge portions 52 of the supported end portions 54 can be reliably drained to the support portions 44.

Furthermore, here, the wall portions 45 have abutting wall portions 48 that abut against the supported end portions 54 and non-abutting wall portions 49 that do not abut against the supported end portions 54. Specifically, the abutting wall portions 48 are formed as a result of parts of the wall portions 45 projecting toward the supported end portions 54 of the bottom frame 51. The clearances C are formed between the supported end portions 54 and the non-abutting wall portions 49 as a result of the abutting wall portions 48 being in abutment against the supported end portions 54. Because of this, here, the clearances C can be reliably formed between the ridge portions 52 of the supported end portions 54 and the wall portions 45 by the abutting wall portions 48.

Furthermore, here, the wall portions 45 extend to a position higher than the upper ends (here, the portions 52*b* that form the substantially flat surfaces) of the ridge portions 52 of the supported end portions 54. Because of this, here, water sticking to the tops of the ridge portions 52 of the supported end portions 54 can be prevented from going outside the bottom frame 51 from the wall portions 45.

(3) Example Modifications

<A>

Figure 7:
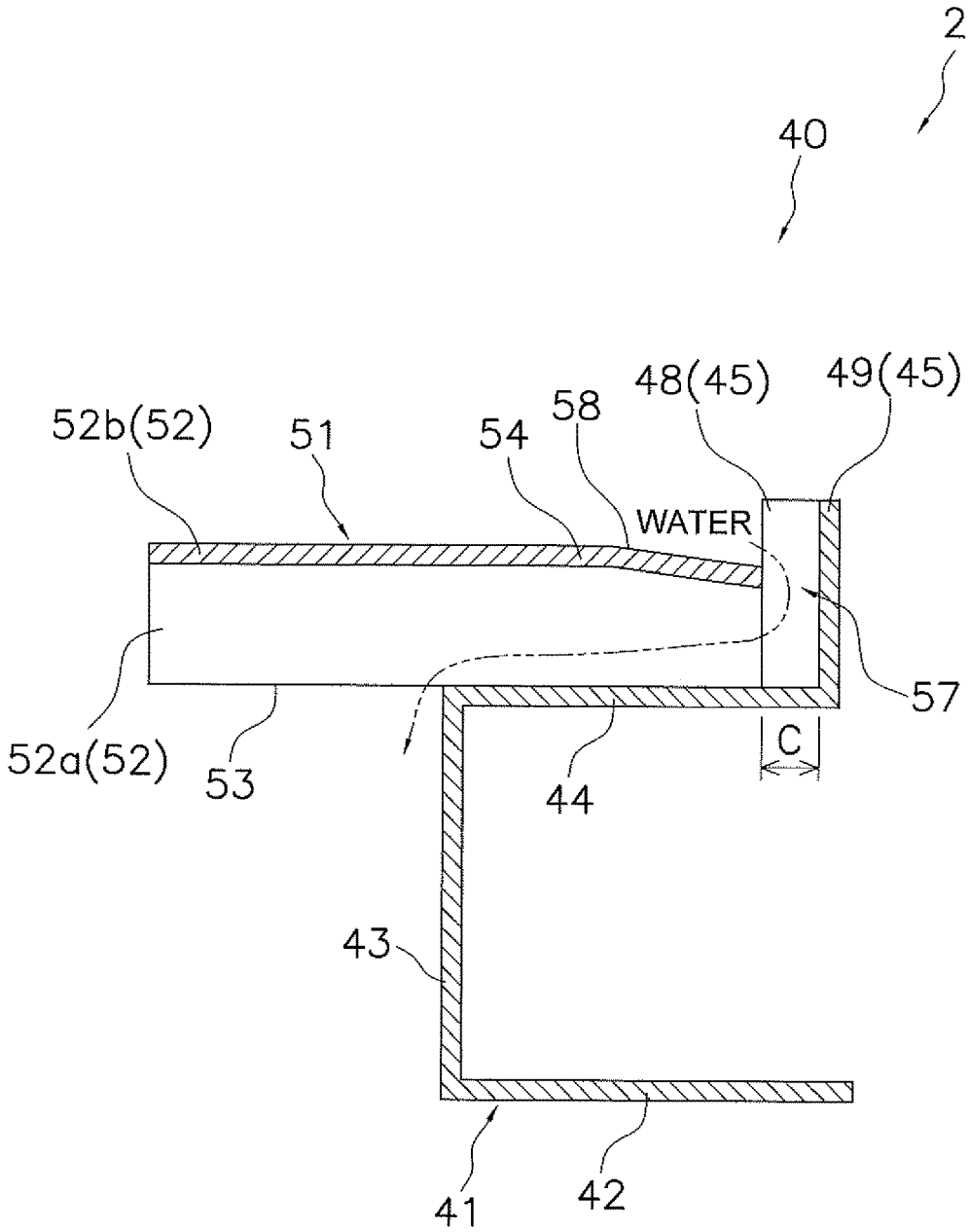
FIG. 7 is a drawing, corresponding to FIG. 6, showing the bottom frame and the mounting foot pertaining to one or more embodiments of modification A.

In the above embodiments, as shown in FIG. 7, downward slopes 58 heading toward the water drainage passages 57 may be formed in the supported end portions 54. In one or more embodiments, water sticking to the tops of the ridge portions 52 of the supported end portions 54 can be guided to the water drainage passages 57, and the water drainage performance can be further improved.

<B>

In the above embodiments and one or more embodiments of modification A, parts of the wall portions 45 are made to project toward the supported end portions 54 to give the wall portions 45 of the mounting feet 41 a configuration having the abutting wall portions 48 that abut against the supported end portions 54 of the bottom frame 51 and the non-abutting wall portions 49 that do not abut against the supported end portions 54, but the heat source unit 2 is not limited to this. Here, although it is not shown in the drawings, parts of the supported end portions 54 may be made to project toward the wall portions 45. In this case also, the abutting wall portions 48 are formed as a result of the projecting portions of the supported end portions 54 of the bottom frame 51 abutting against parts of the wall portions 45 of the mounting feet 41, so the wall portions 45 of the mounting feet 41 can be given a configuration having the abutting wall portions 48 that abut against the supported end portions 54 of the bottom frame 51 and the non-abutting wall portions 49 that do not abut against the supported end portions 54.

<C>

Figure 8:
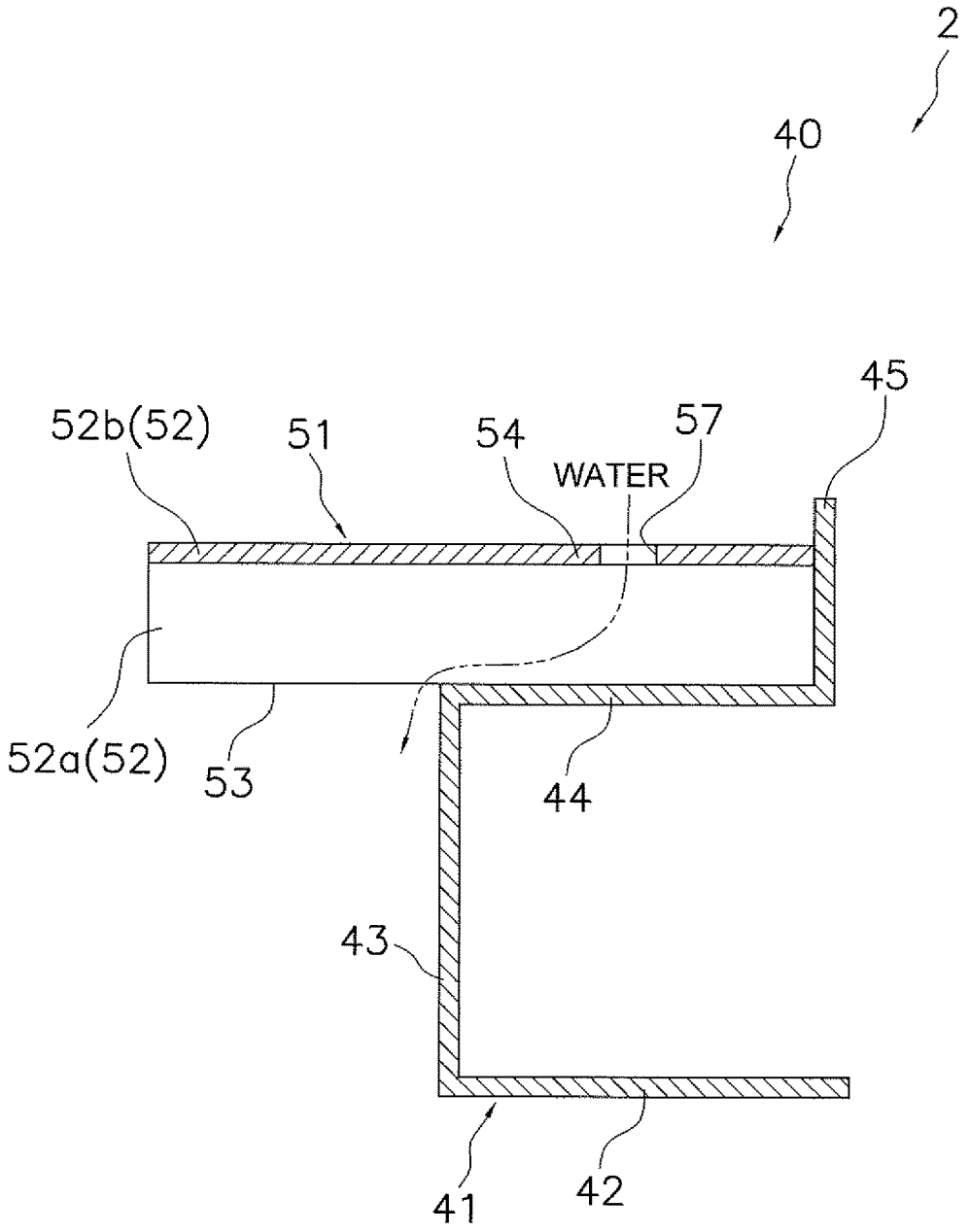
FIG. 8 is a drawing, corresponding to FIG. 6, showing the bottom frame and the mounting foot pertaining to one or more embodiments of modification C.

In the above embodiments and one or more embodiments of modifications A and B, the clearances C formed between the ridge portions 52 of the supported end portions 54 and the wall portions 45 of the mounting feet 41 serve as the water drainage passages 57, but the heat source unit 2 is not limited to this. For example, as shown in FIG. 8, the water drainage passages 57 may also be openings formed in portions of the ridge portions 52 of the supported end portions 54 that oppose the support portions 44 from above. In this case, the water drainage passages 57 are openings, so there is concern of a reduction in the strength of the bottom frame 51 compared to a case where the clearances C of one or more embodiments serve as the water drainage passages 57. However, the openings serving as the water drainage passages 57 are provided in the supported end portions 54—whose strength is increased as a result of being supported by the support portions 44 of the mounting feet 41—of the ridge portions 52 of the bottom frame 51, so a balance between maintaining the strength of the bottom frame 51 and improving the water drainage performance can be achieved. It will be noted that, here, in contrast to one or more embodiments, it becomes unnecessary to form the clearances C, so the supported end portions 54 of the bottom frame 51 may be brought into contact with the wall portions 45 of the mounting feet 41. Furthermore, the openings serving as the water drainage passages 57 may also be cutouts formed in edge portions of the supported end portions 54 rather than through holes. Furthermore, in FIG. 8, the openings serving as the water drainage passages 57 are formed in the portions 52*b* that form the substantially flat surfaces of the ridge portions 52, but the heat source unit 2 is not limited to this; although it is not shown in the drawings here, the openings serving as the water drainage passages 57 may also be formed in the portions 52*a* that form the sloping surfaces of the ridge portions 52 or may be formed in both the portions 52*a* that form the sloping surfaces and the portions 52*b* that form the substantially flat surfaces of the ridge portions 52.

<D>

In the above embodiments and one or more embodiments of modifications A to C, the water drainage passages 57 are formed in both front and rear direction sides of the bottom frame 51, but the water drainage passages 57 may also be formed in just one front and rear direction side of the bottom frame 51. For example, the water drainage passages 57 may be formed in just the back surface side of the bottom frame 51 where it is easy for a large amount of water to stick to the bottom frame 51 as a result of the heat source-side heat exchanger 11 being provided.

<E>

In the above embodiments and one or more embodiments of modifications A to D, the ridge portions 52 of the bottom frame 51 are formed by the portions 52*a* that form the sloping surfaces and the portions 52*b* that form the substantially flat surfaces, but the ridge portions 52 are not limited to this and may also be formed by portions that form substantially vertical surfaces and portions that form substantially flat surfaces. Furthermore, here, the ridge portions 52 and the furrow portions 53 of the bottom frame 51 are formed in such a way as to extend across the front and rear direction of the casing 40, but the ridge portions 52 and the furrow portions 53 are not limited to this and, as in patent document 1, may also be formed in such a way as to extend across the right and left direction of the casing 40. Furthermore, here, the bottom frame 51 comprises only one member, but the bottom frame 51 may also be divided into two members as in patent document 1.

Although the disclosure has been described with respect to only a limited number of embodiments, those skilled in the art, having benefit of this disclosure, will appreciate that various other embodiments may be devised without departing from the scope of the invention. Accordingly, the scope of the invention should be limited only by the attached claims.

INDUSTRIAL APPLICABILITY

One or more embodiments of the present invention are widely applicable to a heat source unit having a corrugated plate-like bottom frame and mounting feet.

REFERENCE SIGNS LIST

2 Heat Source Unit
41 Mounting Feet
44 Support Portions
45 Wall Portions
48 Abutting Wall Portions
49 Non-abutting Wall Portions
51 Bottom Frame
52 Ridge Portions
53 Furrow Portions
54 Supported End Portions
57 Water Drainage Passages (Clearances, Openings)
58 Slopes

CITATION LIST

Patent Literature

Patent Document 1: JP-A No. 2011-158137

The invention claimed is:

1. A heat source unit comprising:

a corrugated plate forming a bottom frame in which ridges and furrows extend across a front and rear direction or across a right and left direction; and mounting feet comprising:

supports that are in direct contact with and that support, from below, the furrows at supported ends of the bottom frame on sides that the ridges and the furrows can be seen; and walls disposed on outer sides of the supported ends and that extend from the supports in an upward direction from a level of the furrows toward the ridges, wherein water drainage passages that drain water sticking to tops of the ridges at the supported ends to the supports are disposed above the supports, and the water drainage passages include clearances formed, in the direction that the ridges and furrows extend, between outermost edges of the ridges at the supported ends and the walls.

2. The heat source unit according to claim 1, wherein the clearances are 2 mm or greater.

3. The heat source unit according to claim 1, wherein the walls have abutting wall portions that abut against the supported ends and non-abutting wall portions that do not abut against the supported ends, and the clearances are disposed between the supported ends and the non-abutting wall portions.

4. The heat source unit according to claim 1, wherein the water drainage passages further comprise openings formed in the ridges at the supported ends, and the openings oppose the supports from above.

5. The heat source unit according to claim 1, wherein the walls extend to a position higher than upper ends of the ridges at the supported ends.

6. The heat source unit according to claim 1, wherein downward slopes heading toward the water drainage passages are formed in the supported ends.

7. A heat source unit comprising:

a corrugated plate forming a bottom frame in which ridges and furrows extend across a front and rear direction or across a right and left direction; and mounting feet comprising:

supports that are in direct contact with and that support, from below, the furrows at supported ends of the bottom frame on sides that the ridges and the furrows can be seen; and walls disposed on outer sides of the supported ends and that extend from the supports in an upward direction from a level of the furrows toward the ridges, wherein each wall and each support on the same side of the bottom frame are directly and continuously connected at the level of the furrows, water drainage passages that drain water sticking to tops of the ridges at the supported ends to the supports are disposed above the supports, and the water drainage passages include openings formed in the ridges at the supported ends, and the openings oppose the supports from above.

* * * * *